United States Patent [19]

Maruoka

[11] 4,280,467

[45] Jul. 28, 1981

[54] AIR-FUEL MIXTURE RATIO CONTROL USING ELECTROSTATIC FORCE

[75] Inventor: Hiroyuki Maruoka, Yokohama, Japan

[73] Assignee: Nissan Motor Company, Limited, Yokohama, Japan

[21] Appl. No.: 61,029

[22] Filed: Jul. 26, 1979

Related U.S. Application Data

[62] Division of Ser. No. 784,722, Apr. 5, 1977, Pat. No. 4,183,337.

[30] Foreign Application Priority Data

| | | | |
|---|---|---|---|
| Apr. 6, 1976 | [JP] | Japan | 51-37729 |
| Apr. 6, 1976 | [JP] | Japan | 51-37730 |
| May 6, 1976 | [JP] | Japan | 51-50935 |
| Jun. 28, 1976 | [JP] | Japan | 51-75584 |

[51] Int. Cl.[3] ..... F02B 51/00; F02M 27/00

[52] U.S. Cl. ..... 123/536; 123/538

[58] Field of Search ..... 123/119 E, 119 EC

[56] References Cited

U.S. PATENT DOCUMENTS

| | | | |
|---|---|---|---|
| 4,051,826 | 10/1977 | Richards | 123/119 E |
| 4,124,003 | 11/1978 | Abe et al. | 123/119 E |
| 4,176,637 | 12/1979 | Cole | 123/119 E |

FOREIGN PATENT DOCUMENTS

| | | | |
|---|---|---|---|
| 2530442 | 1/1976 | Fed. Rep. of Germany | 123/119 E |
| 2449848 | 5/1976 | Fed. Rep. of Germany | 123/119 E |
| 2715222 | 10/1977 | Fed. Rep. of Germany | 123/119 E |

*Primary Examiner*—Wendell E. Burns

*Attorney, Agent, or Firm*—Schwartz, Jeffery, Schwaab, Mack, Blumenthal & Koch

[57] ABSTRACT

Electrostatically charged liquid fuel is introduced into a venturi to be atomized therein and is then applied to the combustion chamber of an engine under the control of electrostatic force for properly controlling the air-fuel mixture ratio.

10 Claims, 22 Drawing Figures

AIR-FUEL MIXTURE RATIO CONTROL USING ELECTROSTATIC FORCE

This a division of application Ser. No. 784,722, filed Apr. 5, 1977 now U.S. Pat. No. 4,183,337 issued Jan. 15, 1980.

BACKGROUND OF THE INVENTION

The present invention relates generally to an arrangement for use with an internal combustion engine, and particularly to such an arrangement for controlling an air-fuel mixture ratio by means of electrostatic force.

Several systems or arrangements have been proposed to effectively reduce noxious components contained in exhaust gases from an internal combustion engine. Each of such systems or arrangements requires considerably large changes in a carburetor and/or combustion chambers, resulting in the fact that it is complicated in structure and therefore expensive.

SUMMARY OF THE INVENTION

A primary object of the present invention is to provide an improved arrangement for use with an internal combustion engine for effectively controlling an air-fuel mixture ratio by means of electrostatic force.

Another object of the present invention is to provide an improved arrangement for use with an internal combustion engine, which arrangement concentrates a rich air-fuel mixture in the vicinity of electrodes of a spark plug by means of electrostatic force.

Another object of the present invention is to provide an improved arrangement for use with an internal combustion engine, which arrangement controls the air-fuel ratio of the air-fuel mixture fed to each of the combustion chambers by means of electrostatic force.

These and other objects, features and many of the attendant advantages of this invention will be appreciated more readily as the invention becomes better understood from the following detailed description, wherein like parts in each of the several figures are identified by the same reference characters:

FIG. 1 is a schematic illustration of a first preferred embodiment of the present invention;

FIG. *2a* is a side view, partly in longitudinal section, illustrating a member used in the arrangement of FIG. 1;

FIG. *2b* is an elevation of the member of FIG. *2a;*

DETAILED DESCRIPTION OF PREFERRED EMBODIMENTS

Figure 1:
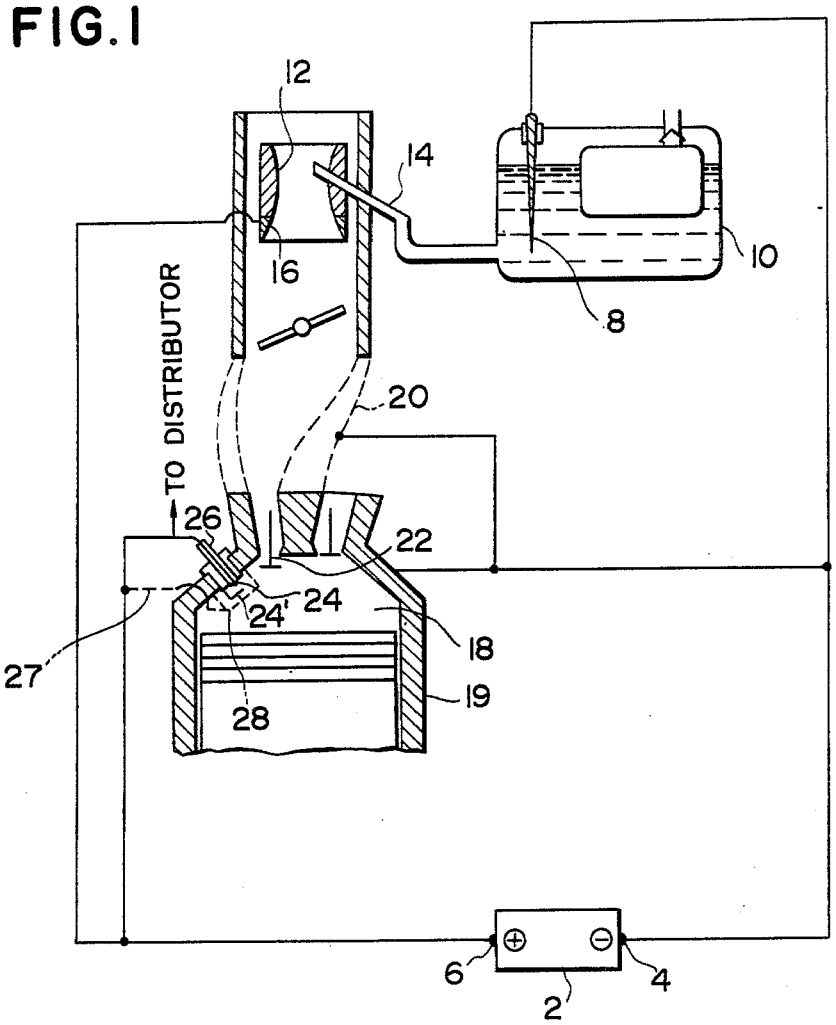
Figure 2A:
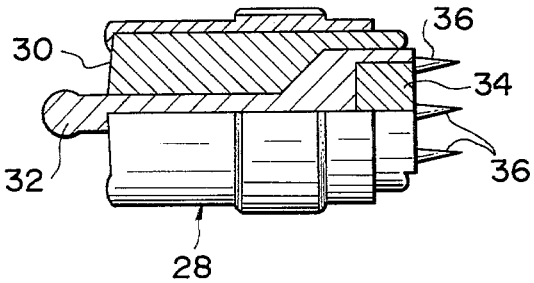
Figure 2B:
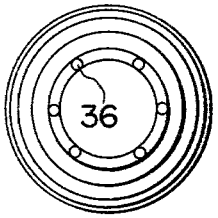

Reference is now made to FIG. 1, which illustrates schematically a first preferred embodiment of the present invention. An electrostatic charging means 2 such as a high d.c. voltage supply is connected through its negative output terminal 4 to an electrode 8 of the needle type which protrudes into a float bowl 10 in order to charge a liquid fuel confined in the float bowl. The output potential of the charging means 2 is usually within a range from several thousands to tens of thousands of volts. The charged liquid fuel is then introduced into a venturi 12 through a main nozzle 14. The charged liquid fuel, as is well known in the art, is atomized in the venturi more easily than the non-charged fuel. It is preferable that another electrode 16, which is connected to the electrostatic charging means 2 through a positive output terminal 6, is provided in the vicinity of the main nozzle 14 for accelerating the charged fuel droplets. In FIG. 1, the electrode 16 is a portion of the venturi 12 and electrically insulated from the remainder of the venturi 12 which is made of dielectric material, but can be provided independently of the venturi 12 although this embodiment is illustrated. The atomized fuel is mixed with air from an air cleaner (not shown) and then fed to a cylinder 18 through both an intake passage 20 and an intake port 22. The center electrode 24 of a spark plug 26 is connected to the electrostatic charging means 2 through the positive output electrode 6 so as to make the air-fuel mixture rich in the vicinity thereof due to the electrostatic attractive force between the positively charge electrode 24 and the negatively charged fuel droplets, thereby making it easy to ignite the air-fuel mixture. Therefore, according to the present embodiment, a considerably lean air-fuel mixture can be easily ignited so that this embodiment is advantageous when used with a so called two-stage combustion system or an exhaust gas recirculation system. The two-stage combustion is, in this specification, defined applying the rich air-fuel mixture to one group of combustion chambers while applying the lean air-fuel mixture to the remainder of the combustion chambers. It is known that nitrogen oxides ($NO_x$) can be effectively reduced by this measure.

As shown in FIG. 1, it is preferable that the intake passage 20 and the cylinder 19 are connected to the electrostatic charging means 2 through the negative output terminal 4 in order to avoid sticking of the fuel droplets to the inner walls thereof. In this case, the negatively charged cylinder 19 serves to concentrate the fuel droplets in the vicinity of the positively charged electrode 24.

The voltage applied from the electrostatic charging means 2 to the electrode 24 should be determined so as not to discharge between it and another electrode 24' or the inner wall of the cylinder 19 to remove the possibility of undesirable ignition of the air-fuel mixture. In the above, in substitution for the connection of the electrostatic charging means 2 to the center electrode 24, another electrode 28 is provided within the cylinder 19 and in the vicinity of the spark plug 26, which electrode 28 is connected to the positive output terminal 6 of the electrostatic charging means 2 as shown by a broken line 27.

As previously referred to, the voltage applied to the electrode 24 or 28 should be below a threshold value above which the undesirable firing occurs. To this end, although not shown in the drawing, suitable means such as a voltage divider is provided in order to apply an adequate potential to the electrode 24 or 28.

If the spark plug 26 is insulated from the cylinder 19, another electrode 24' of the plug 26 can be used as an electrostatic electrode for the aforesaid purpose of the present embodiment.

Reference is now made to FIGS. *2a* and *2b*, which illustrate an example of the electrode 28 in FIG. 1. A conductive member 32 is provided for connection of electrode 36 of the needle type to the electrostatic charging means 2. The electrodes 36 are provided separately as shown in the drawings. The reason why the electrodes 36 is of needle-like configuration is that, as is well known in the art, each of the pointed portions does not otherwise produce a high electrostatic field therearound.

Figure 3:
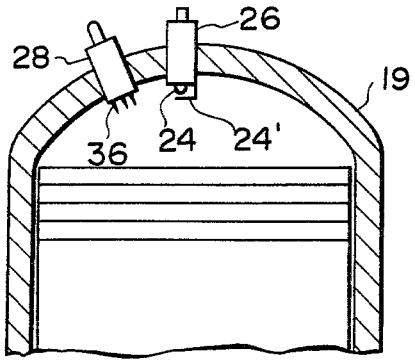
FIG. 3 shows an installation of the member of FIG. *2a* in a cylinder.

FIG. 3 illustrates an example of an installation of the electrode 28 in the cylinder 19.

Figure 4:
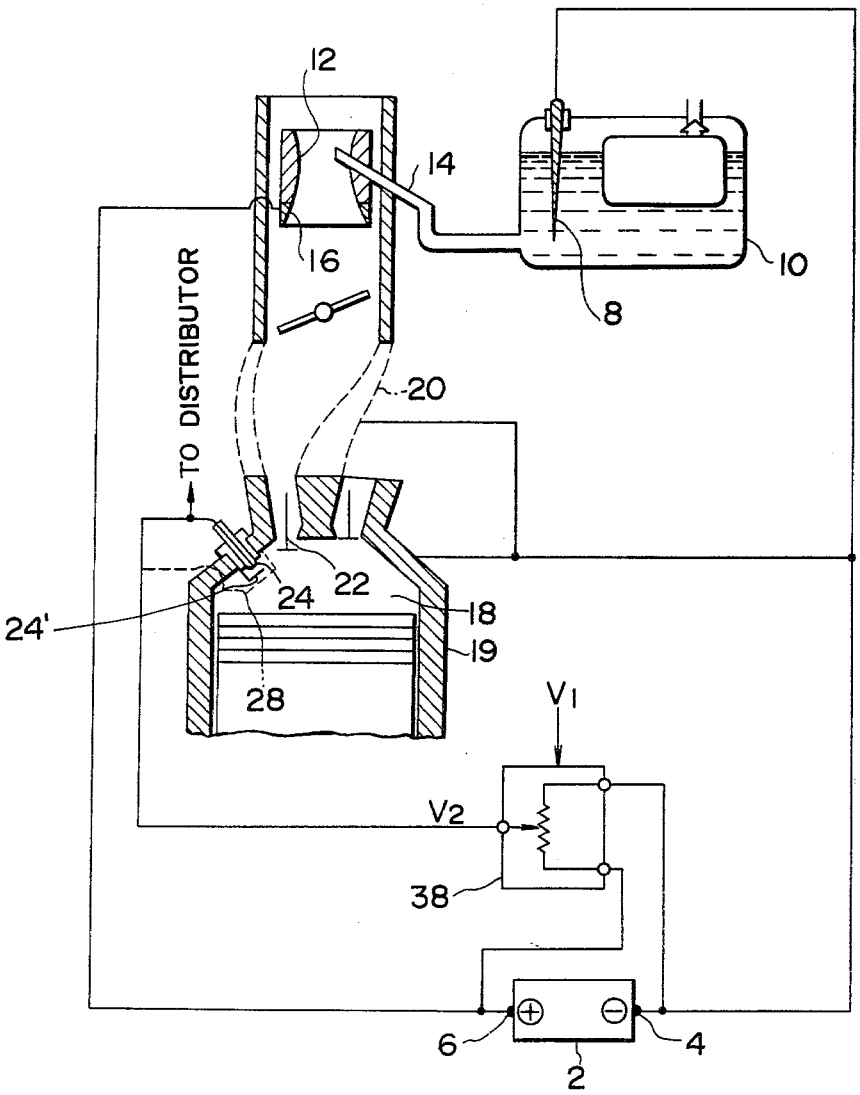
FIG. 4 illustrates a modification of the first preferred embodiment of FIG. 1.

Reference is now to FIG. 4, wherein a modification of the first preferred embodiment is illustrated. The difference between the arrangements of FIGS. 1 and 4 is that the latter is provided with a control unit 38. The control unit 38 receives a control signal $V_1$ which represents at least one engine operation parameter such as engine speed, the amount of air intake, vacuum pressure in an intake passage, or engine temperature. The control unit 38 controls, depending upon at least one control signal applied thereto, the voltage at the electrode 24 or 28. The control of the voltage of the electrode 24 or 28 has various advantages as will be described hereinafter. The threshold voltage, over which the undesired firing occurs, is controlled to be low at idling of the engine, and, on the other hand, to become high at high engine speed. More specifically, under the condition of high engine speed, it is necessary to concentrate the negatively charged droplets about the electrode 24 or 28 during a considerably short time period, so that, if the voltage applied to the electrode 24 or 28 is low at idling and high at high engine speed, control of the concentration of the air-fuel mixture around the electrode 24 or 28 can be effectively performed. In the above, although not shown in FIG. 4, it is preferable that the electrode 16 is connected to the control unit 38 in order that the voltage applied thereto is controlled, by at least one engine operation parameter, for further proper control of the concentration of the air-fuel mixture around the electrodes of the spark plug 26.

In the foregoing, the liquid fuel is negatively charged, but alternatively can be positively charged. In this case, the electrodes 16, 24, etc. should be negatively charged. Furthermore, the electrostatic charging means 2 is not restricted to a direct current power source but can be replaced by a low frequency alternating power source. On the other hand, with respect to the charging of the liquid fuel, the arrangement can be modified such that, in substitution for the electrode 8, the electrostatic charging means 2 is connected to the float bowl 10 or the nozzle 14 both made of electrically conductive material.

It is understood from the foregoing that the present embodiment is very suitable for firing the lean air-fuel mixture. More specifically, it is very suitable for use in EGR (exhaust gas recirculation) system so that the noxious component $NO_x$ can be effectively reduced.

Furthermore, in accordance with the present embodiment, a good quality of the air-fuel mixture can be obtained in that the charged liquid fuel can be readily atomized in the venturi 12.

What is claimed is:

1. Arrangement for use with an internal combustion engine, comprising in combination:

means for producing first and second electrostatic charges of opposite polarities;

means for forming a combustible air-fuel mixture;

a first electrode connected to said electrostatic charging means for imparting said first charge to a liquid fuel introduced into said combustible air-fuel mixture forming means;

a plurality of combustion chambers, each combustion chamber including a spark plug disposed therein for igniting the air-fuel mixture admitted thereinto; and a plurality of second electrodes, one each being provided within each of said combustion chambers and being connected to said electrostatic charging means for receiving said second charge from the electrostatic charging means; whereby the air-fuel mixture is made rich in each combustion chamber in the vicinity of said second electrode.

2. Arrangement as claimed in claim 1, wherein each of the second electrodes comprises the center electrode of said spark plug.

3. Arrangement as claimed in claim 1, wherein each of said second electrodes comprises one of the two electrodes of said spark plug electrically insulated from the combustion chamber.

4. Arrangement as claimed in claim 1, wherein, in each respective combustion chamber, each of said second electrodes is provided in the vicinity of said spark plug.

5. Arrangement as claimed in claim 1, wherein said combustible air-fuel mixture forming means includes a venturi, and further comprising a third electrode provided in the vicinity of said venturi and connected to said electrostatic charging means for receiving said second charge therefrom.

6. Arrangement as claimed in claim 1, wherein said combustible air-fuel mixture forming means includes a venturi, and further comprising a third electrode integral with said venturi, said third electrode being electrically insulated from the remainder of the venturi and being connected to said electrostatic charging means for receiving said second charge therefrom.

7. Arrangement as claimed in claim 1, wherein the engine further includes a plurality of intake passages and said electrostatic charging means is electrically connected to both said intake passages and said combustion chambers for receiving said first charge, thereby to prevent adherence of atomized fuel to the inner walls thereof.

8. Arrangement as claimed in claim 1, further including means for controlling the amount of said second charge imparted to said second electrodes in accordance with at least one engine operation parameter.

9. Arrangement as claimed in claim 8, wherein said engine parameter is the engine speed.

10. Arrangement as claimed in claim 1, wherein said first electrode comprises a discharging nozzle protruding into a venturi.

* * * * *